United States Patent [19]

Sheridan

[11] 3,994,670

[45] Nov. 30, 1976

[54] FURNACE HEATING

[75] Inventor: Anthony Terence Sheridan, Rotherham, England

[73] Assignee: British Steel Corporation, London, England

[22] Filed: July 14, 1975

[21] Appl. No.: 595,603

[30] Foreign Application Priority Data

July 26, 1974 United Kingdom ..... 33213/74

[52] U.S. Cl. ..... 431/174; 431/115; 432/150; 432/199; 432/193; 432/196

[51] Int. Cl.[2] ..... F23C 5/24

[58] Field of Search ..... 431/174, 178, 179, 180, 431/9, 115, 116, 285; 432/199, 176, 150, 144, 193, 196

[56] References Cited

UNITED STATES PATENTS 1,614,085 1/1927 Runyan ..... 431/9 X

FOREIGN PATENTS OR APPLICATIONS 522,551 9/1953 Belgium ..... 432/176

3,377 4/1956 Germany ..... 432/176

*Primary Examiner*—Edward G. Favors

*Attorney, Agent, or Firm*—Bacon & Thomas

[57] ABSTRACT

This invention relates to a U-fired soaking pit in which an auxiliary burner 4, e.g. a tunnel burner, is located below the main burner 3 to supplement the heat flow and heat transfer therefrom. The auxiliary burner is mounted between twin exhaust flue 5,6 and is vertically in line with the main burner, the main and auxiliary burners being disposed equi-distantly from one another and from the top and bottom of the furnace, respectively.

12 Claims, 3 Drawing Figures

FIG. 1.
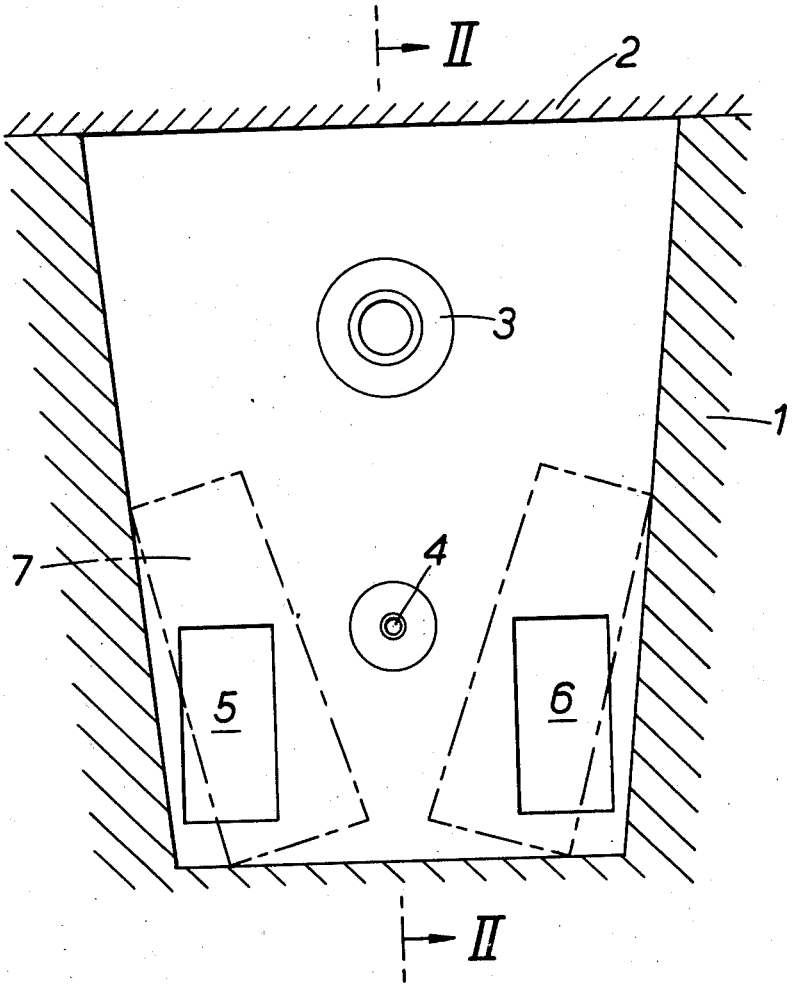
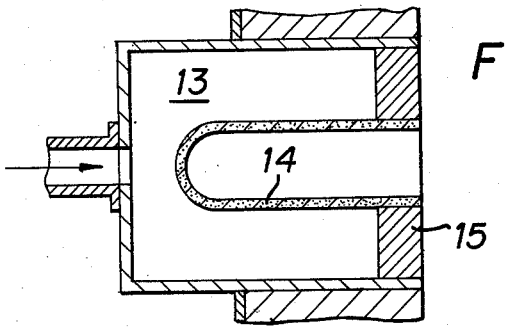
FIG. 3.

FURNACE HEATING

This invention relates to fuel-fired furnaces, and more particularly relates to soaking pits for heating steel ingots prior to rolling.

From one aspect the present invention provides a fuel-fired furnace of generally rectangular section having at one end a main fuel burner located above an exhaust flue and directed towards the other end of the furnace whereby the heat flow pattern executes a U-shaped path, and an auxiliary burner located below the main burner in the said one end supplementing the heat flow and heat transfer therefrom.

Preferably, twin exhaust flues are disposed side-by-side, the auxiliary burner being mounted between them vertically in line with the main burner centrally on the end wall. The two burners may be mounted equidistantly from one another and the top and bottom of the furnace, respectively.

The main burner, or both the main and auxiliary burners, may be provided with means for varying the axial 'swirl' of the flames the combustible fuel and air issuing through a venturi office, but preferably only the main burner is of this design, the auxiliary burner being of a high momentum, low thermal input type, e.g. a 'tunnel' burner in which a pre-mixed combustible fuel-/air mixture is forced through an open-ended or a closed porous refractory tube 'tunnel'.

The auxiliary burner is designed to operate at a higher thrust/fuel flow ratio than the main burner but with the fuel input to the latter being much greater than the auxiliary burner, e.g. between 10:1 and 30:1, typically of the order of 15:1; the auxiliary to main burner thrust ratio may conveniently lie between 0.5 and 0.05; typically this ratio will be of the order of 0.1.

The provision of the auxiliary burner and its disposition relative to the main burner and the exhaust flues enables the temperature distribution within the pit when loaded with ingots to be much more uniform as compared with conventional U-fired furnaces. As a consequence the temperature differences between the various faces of each ingot have been found to be markedly reduced.

In order that the invention may be fully understood, one embodiment thereof will now be described, by way of example; with reference to the accompanying drawings in which:

FIG. 1 is a sectional end elevation through a furnace (soaking pit) according to this invention loaded with ingots;

FIG. 3 is a sectional side elevation through an alternative form of auxiliary burner;

Figure 2:
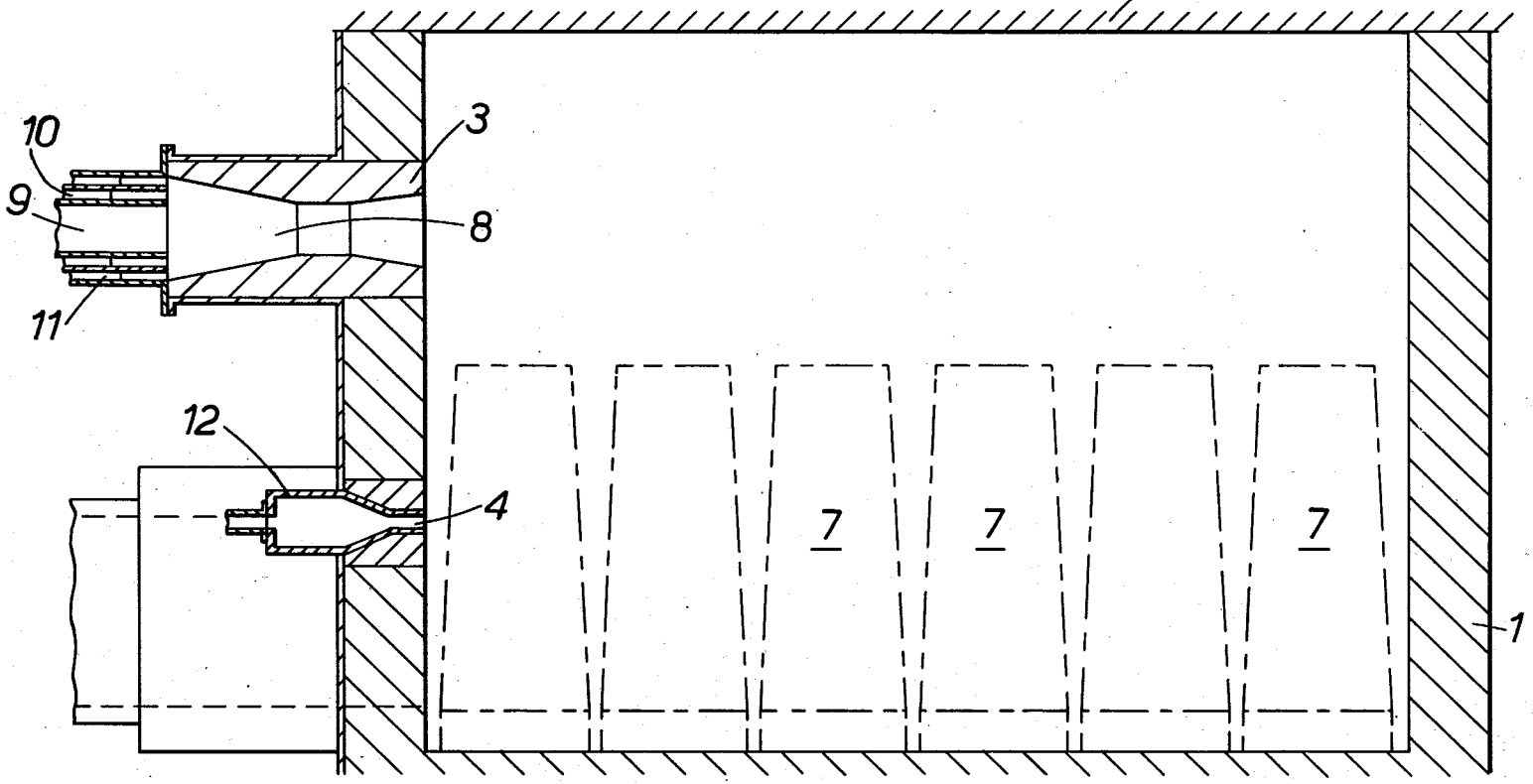
FIG. 2 is a sectional side elevation along II — II in FIG. 1.

Referring now to the drawings, the furnace is defined by a pit 1 and a roof 2 both of which are refractory lined. Main and auxiliary burners 3 and 4 are located centrally on one end wall about one-third and two-thirds of the way down from the roof, respectively, and twin exhaust flues 5, 6 are located in the lower part of the same wall. The pit is loaded with a dozen steel ingots 7 in two rows, the ingots being laid in a regular slanted fashion against the side wall.

The main burner may be of a design such as to effect a variation in the axial 'swirl' of the flames.

In particular, this is effected by forcing air into the area of the refractory venturi (8) concentrically with the fuel (gas) issuing through a central tube 9, the air being propelled through axial vanes 10 in an inner annular channel and through swirl 'deflector' vanes 11 with an outer annular channel.

The auxiliary burner is designed to have a much higher thrust/fuel flow ratio than the main burner and is constructed as a tunnel burner, a pre-mixed combustible gas/air mixture being propelled through an open-ended refractory tube 12.

In operation, the thrusts from the main and auxiliary burners are adjusted so that the jet from the auxiliary burner reaches the end wall but with insufficient momentum flux to deflect the jet from the main burner up on to the roof. In this way the gas flow is caused to return to the flues by passing between the ingots and the pit walls thereby increasing the heat transfer to the normally coldest parts of the ingots. This results in a reduction of face to face and top to bottom temperature differences in the ingots and end to end temperature differences in the pit although this factor can also be controlled by variation of the swirl applied to the flow through the main burner.

Experimental work entailing the measurement within the pit of the combined velocity profiles of the burners, and the degree of mixing between them, has shown that to avoid unfavourable flow patterns the auxiliary to main burner thrust ratio should lie between 0.5 and 0.05; similarly the thermal power (fuel) ratio will typically lie between 0.10 and 0.03. The disposition of the burners in the arrangement illustrated has been shown to be conducive to the flow pattern desired, the position of the auxiliary burners in the lower half of the pit causing the necessary degree of heat transfer to this area whilst avoiding excessive heating of the adjacent ingots or 'washing' of their inside faces, an adverse factor which might also be realised should the auxiliary jet be directed downwardly instead of being parallel with the main jet. Typical practical figures with the arrangement shown are as follows: auxiliary burner thrust 1.5 N, auxiliary burner fuel flow rate 8.5 kilograms/hour, main burner thrust 5.45 N main burner fuel flow rate 109 Kg/hour.

Although the invention has been described with reference to the particular embodiment illustrated, it is to be understood that various modifications may be made without departing from the scope of this invention. For example, it is not essential for the main and auxiliary burners to be of the designs shown; the main burner could alternatively be of a fixed swirl type, indeed practice has shown that swirl variation is not necessary in many instances, and the auxiliary burner could also be of the same type as the main burner. A different form of tunnel burner might also conveniently be adopted as the auxiliary, the principal requirement of this burner being that of having a high thrust/mass flow ratio. One such form of tunnel burner is the closed porous refractory tube burner shown in FIG. 3. In this instance the pre-mixed combustible gas/air mixture is propelled into a chamber 13 and issues through a hollowed porous refractory tube 14 defining a tunnel wherein it is ignited, this tube being supported by an annular impervious refractory block 15.

We claim:

1. A fuel fired furnace of generally rectangular section and having at one end only, an exhaust flue, a main fuel burner located above the flue and directed towards the other end of the furnace whereby the heat flow executes a U-shaped path, and an auxiliary burner displaced from the exhaust flue and located below the main burner in the said one end supplementing and modifying the heat flow and heat transfer therefrom whereby to establish a uniform temperature distribution in said furnace.

2. A furnace according to claim 1, comprising two exhaust flues disposed side-by-side, the auxiliary burner being mounted between them vertically in line with the main burner centrally on the end wall.

3. A furnace according to claim 2, wherein the main and auxiliary burners are mounted equidistantly from one another and the top and bottom of the furnace, respectively.

4. A furnace according to claim 2, wherein the main burner has a venturi orifice and is designed to provide a fixed swirl of the flames, combustible fuel and air issuing through the orifice.

5. A furnace according to claim 2, wherein the main burner has a venturi orifice and variable vanes for providing a variable swirl of the flames, combustible fuel and air issuing through the orifice.

6. A furnace according to claim 2 wherein the auxiliary burner is a tunnel burner in which a pre-mixed combustible fuel/air mixture is forced through a closed porous, or an open-ended, refractory tube.

7. A furnace according to claim 6, wherein the auxiliary burner is designed to operate at a higher thrust/fuel flow ratio than the main burner.

8. A furnace according to claim 7, wherein the auxiliary burner to main burner thrust ratio lies between 0.5 and 0.05.

9. A furnace according to claim 8, wherein the auxiliary burner to main burner thermal power ratio lies between 0.1 and 0.03.

10. A fuel fired soaking pit furnace of generally rectangular section for heating metal ingots, said furnace having at one end only, exhaust flue means, a main fuel burner providing a swirl to the flames issuing therefrom, said main burner being located above the flue means and directing the flames towards the other end of the furnace whereby the heat flow executes a U-shaped path from the burner to the exhaust flue means, and an auxiliary tunnel burner displaced from the exhaust flue and located below the main burner in the said one end supplementing and modifying the heat flow and heat transfer therefrom whereby to establish a uniform temperature distribution in said furnace.

11. A furnace according to claim 10, wherein the exhaust flue means comprises a pair of exhaust flues disposed side-by-side, the auxiliary burner being mounted between them vertically in line with the main burner centrally on the end wall, the main and auxiliary burners being mounted equidistantly from one another and the top and bottom of the furnace, respectively.

12. A furnace according to claim 10, wherein the auxiliary burner is designed to operate at a higher thrust/fuel flow ratio than the main burner.

* * * * *